US010723605B2

(12) United States Patent
Ivey

(10) Patent No.: US 10,723,605 B2
(45) Date of Patent: Jul. 28, 2020

(54) FORKLIFT ADAPTER

(71) Applicant: Ivey Enterprises LLC, Baton Rouge, LA (US)

(72) Inventor: Brandon Ivey, Greenwell Springs, LA (US)

(73) Assignee: Ivey Enterprisers LLC, Baton Rouge, LA (US)

( * ) Notice: Subject to any disclaimer, the term of this patent is extended or adjusted under 35 U.S.C. 154(b) by 0 days.

(21) Appl. No.: 16/667,046

(22) Filed: Oct. 29, 2019

(65) Prior Publication Data

US 2020/0062564 A1 Feb. 27, 2020

Related U.S. Application Data

(63) Continuation of application No. 15/840,677, filed on Dec. 13, 2017, now Pat. No. 10,556,783.

(60) Provisional application No. 62/523,374, filed on Jun. 22, 2017.

(51) Int. Cl.

| | |
|---|---|
| ***B66F 9/19*** | (2006.01) |
| ***B66F 9/18*** | (2006.01) |
| ***B66F 9/12*** | (2006.01) |

(52) U.S. Cl.

CPC ..... *B66F 9/19* (2013.01); *B66F 9/12* (2013.01); *B66F 9/18* (2013.01)

(58) Field of Classification Search

CPC ..... B66F 9/19; B66F 9/18
USPC ..... 414/785, 607
See application file for complete search history.

(56) References Cited

U.S. PATENT DOCUMENTS

| | | | | | |
|---|---|---|---|---|---|
| 3,176,866 | A * | 4/1965 | Meister, Jr. | B66F 9/18 | 414/607 |
| 3,455,476 | A * | 7/1969 | Grigsby | B66F 9/18 | 414/607 |
| 3,596,776 | A * | 8/1971 | Melin | B65G 57/00 | 414/788 |
| 3,659,732 | A * | 5/1972 | Downey | B66F 9/186 | 414/608 |
| 3,947,064 | A * | 3/1976 | Skoting | B66C 1/16 | 294/67.4 |
| 4,036,383 | A * | 7/1977 | Allen | B66F 9/19 | 414/420 |
| 4,395,188 | A * | 7/1983 | Kaup | B66F 9/125 | 414/622 |
| 4,838,752 | A * | 6/1989 | Bryant | B66F 9/19 | 414/421 |
| 4,881,866 | A * | 11/1989 | Harmon | B65G 49/061 | 414/607 |
| 5,692,872 | A * | 12/1997 | Raben | B66F 9/12 | 414/607 |

(Continued)

*Primary Examiner* — Kaitlin S Joerger
(74) *Attorney, Agent, or Firm* — Lauren J. Rucinski; Robert Devin Ricci; Kean Miller LLP

(57) ABSTRACT

The invention disclosed herein is a forklift adapter comprising multiple metal bars which create a payload carriage and two insertion points for traditional forklift forks. The adapter is capable of transporting payloads over obstacles and of precisely positioning the payload at the specified drop location. The adapter redirects the forklift insertion point such that the insertion point is perpendicular to the adapter bottom supports thereby transferring the support load of the forks from the bottom of the payload to the top of the payload. The adapter allows a forklift to position a payload over railings and reverse away from the payload.

8 Claims, 6 Drawing Sheets

(56) References Cited

U.S. PATENT DOCUMENTS

| | | | | |
|---|---|---|---|---|
| 6,149,373 | A * | 11/2000 | Gesuale | B66F 9/18 414/607 |
| 6,764,269 | B1 * | 7/2004 | Cannata | B66F 9/18 414/607 |
| 7,214,025 | B2 * | 5/2007 | Rudolph | B66F 9/18 186/63 |
| 7,597,526 | B2 * | 10/2009 | Benson | B21C 47/242 414/420 |
| 7,874,784 | B2 * | 1/2011 | Teeters, II | B66F 9/18 414/607 |
| 7,967,545 | B2 * | 6/2011 | Lauvdal | B66F 9/182 414/607 |
| 8,444,366 | B2 * | 5/2013 | Cole | B66C 9/18 414/607 |
| 8,585,344 | B2 * | 11/2013 | Sharp | B66F 9/142 187/237 |
| 9,546,082 | B2 * | 1/2017 | Balcom | B66F 9/18 |
| 9,745,025 | B1 * | 8/2017 | Miller | B63B 27/10 |
| 2003/0215318 | A1 * | 11/2003 | Buzzoni | B60T 3/00 414/607 |
| 2004/0208734 | A1 * | 10/2004 | Shoemyer | B66F 9/18 414/607 |
| 2007/0170002 | A1 * | 7/2007 | Ziebell | B66F 9/12 187/237 |
| 2010/0189536 | A1 * | 7/2010 | Morgan | B66F 9/12 414/785 |
| 2013/0277151 | A1 * | 10/2013 | Giannetti | B66F 9/183 187/237 |
| 2018/0072548 | A1 * | 3/2018 | Hokanson | B66F 9/18 |

* cited by examiner

FORKLIFT ADAPTER

CROSS REFERENCE TO RELATED APPLICATIONS

This application is a Continuation of U.S. patent application Ser. No. 15/840,677 filed Dec. 13, 2017 entitled "FORKLIFT ADAPTER", which claims benefit to the provisional U.S. Application 62/523,374 "FORKLIFT ADAPTER" filed Jun. 22, 2017.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

DESCRIPTION OF THE DRAWINGS

The drawings constitute a part of this specification and include exemplary embodiments of the Forklift Adapter, which may be embodied in various forms.

BACKGROUND

Figure 1:
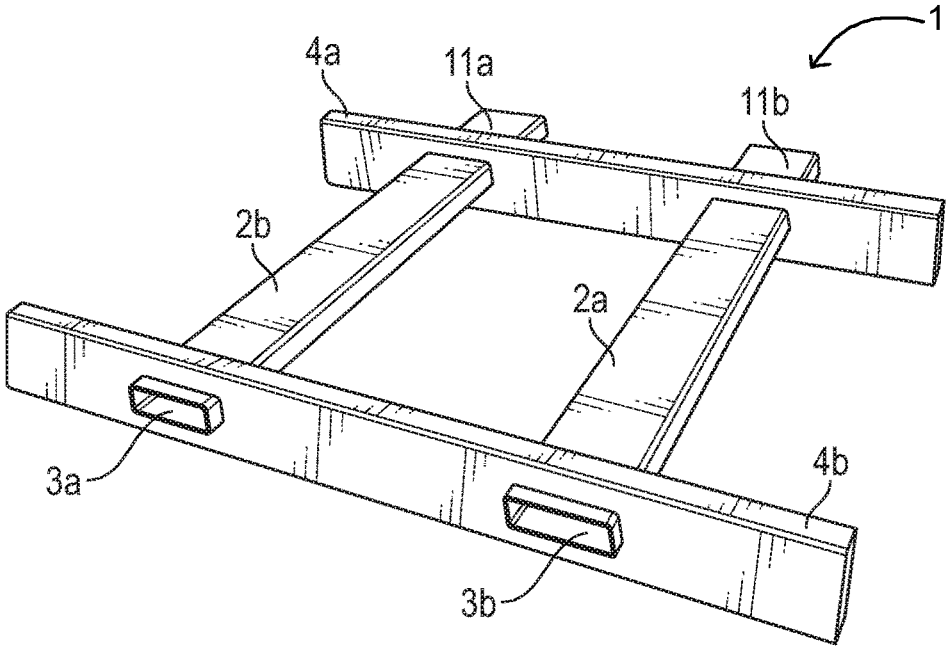
FIG. 1 is a depiction of one embodiment of the Forklift Adapter which comprises four metal bars and two fork insertion points.

A forklift (also known as a lift truck, fork truck, or forklift truck) is an industrial vehicle used to transport materials short distances. Generally, a forklift comprises a frame atop four wheels, an area for a human-operator, and two "forks" or long thin blades attached to a carriage for contact with the payload. The operator can control the forks through hydraulic controls that move the forks up and down. During basic operations, the forklift operator approaches a payload head-on (with the forks aimed at the payload) and in the lowered position, drives the forks into the payload through specified openings, and raises the forks, lifting the payload. The operator then drives the payload to the specified drop location and lowers the forks, setting the payload down onto the surface of the specified drop location. Once the payload is in place, the operator reverses the forklift, removing the forks from the specified openings in the payload and leaving the payload in place. Forklifts are rated for certain load capacities (generally between one and five tons) and are limited by the need to maintain the center of gravity of the forklift while raising, lowering, and transporting a payload.

Many retailers utilize forklifts in order to deliver merchandise stored in pallets or in crates or stored as lose product (such as lumber or drywall) to a waiting customer's vehicle or vehicle trailer. Many common utility cargo trailers have side rails and a rear ramp gate. When a forklift approaches a trailer with side rails, operations are limited in two respects. First, although the forklift can lift the payload over the railing by raising the forks, when the operator lowers the forks to place the payload onto the bed of the trailer, the bottom side of the forks often comes into contact with the top of the side rails. This contact could damage the railing. Even if the frame and length of the forks allow for the forks to extend beyond the railing, once the payload is lowered onto the bed of the trailer, the forks cannot be removed from the payload openings. The forklift is unable to reverse away because the forks will be located interior to the railing. Driving the forklift up the rear ramp gate presents extreme safety hazards because of the delicate center of gravity balance between the frame of the forklift and the load on the forks. Further, rear ramps are generally not built to withstand the weight of the forklift. Therefore, this approach is not favorable. Second, often times the payload is extremely heavy and must be placed strategically in the trailer. If not carefully placed, the force created by the weight of the payload could even lift the backend of the customer's vehicle with potential damage to the vehicle's frame, trailer hitch, and to the trailer itself. Traditional forklifts generally cannot offer precise loading because the dimensions of the frame and forks limit the reach of the forklift and known methods are clumsy at best.

Traditional methods of handling these issues include using two forklifts, one to put the payload in place and another to "push" the payload off of the first forklift. This method is not only extremely time consuming, but also unacceptably dangerous to human operators. Pushing the payload using the forks also creates the risk of damaging the product. Further, other forklift attachments are limited by the extension of the forks and frame dimensions, compounded by the physical requirements dictated by the forklift's center of gravity. Many do not compensate for the desire to reverse the forklift away from the payload after placing the payload, failing to adequately address structural obstacles such as railings.

Forklifts are used in thousands of retailers to perform this type of transport with similar payloads every day. Therefore, a new product is needed to provide a safe and time efficient means to transport merchandise from the stock room to a customer's vehicle or trailer. The forklift adapter described herein provides such a novel means to transport and position payloads including pallets, crates, and loose materials onto a surface, wherein access to the surface is obstructed by another structure, such as a railing. The adapter redirects the fork insertion point so that the insertion point for the payload is perpendicular to, rather than parallel to, the frame and forks of the forklift. The adapter allows a forklift to place the payload in the desired position and then reverse away from the payload. Additionally, the payload is supported by the forks from above rather than from below the payload. Therefore, the forklift is capable of placing a load in a particular location on an obstructed surface (such as a trailer bed with railing) and reversing away, leaving the payload and adapter in place. The adapter can then be removed either by the forklift or through other physical or mechanical means.

DETAILED DESCRIPTION

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies.

Furthermore, the described features, structures, or characteristics may be combined in any suitable manner in one or more embodiments. In the following description, numerous specific details are provided, such as examples of materials, payloads, and dimensions. One skilled in the relevant art will recognize, however, that the Forklift Adapter may be practiced without one or more of the specific details, or with other methods, components, materials, and so forth. In other instances, well-known structures, materials, or operations are not shown or described in detail to avoid obscuring aspects of the invention.

FIG. 1 depicts one embodiment of the Forklift Adapter. In this embodiment, the adapter 1 comprises four hollowed, metal beams connected such as by welding in a near hash mark configuration. Two of the beams 2*b*, 2*c* are parallel to each other. In one embodiment the beams 2*b*, 2*c* are between 2 and 4 feet apart and are approximately 4 inches in width and 48 inches in length. However, in other embodiments, the length, width, and separation distance may vary based on the dimensions of the forklift forks (the "forks"). Forklifts come in standard sizes and therefore the beams may be designed to meet standard specifications. The other two beams 4*a*, 4*b* are perpendicular to the first set of beams 2*b*, 2*c* and parallel to each other. The intersection of the two other beams 4*a*, 4*b* and the first set of beams 2*b*, 2*c* form a payload carriage. In one embodiment, the other two beams 4*a*, 4*b* are approximately four feet from each other and are the same dimensions as the two parallel beams 2*b*, 2*c*. However, as explained above, the dimensions of the adapter 1 and beams can vary based on the dimensions of the forks. In one embodiment, the two sets of beams are joined, such as by welding, together at the intersection points. The two parallel beams 2*b*, 2*c* extend through the other two beams 4*a*, 4*b* at the intersection points. The two parallel beams 2*b*, 2*c* extend approximately one foot beyond the intersection point on one end 11*a*, 11*b*. On the other end, the two parallel beams 2*b*, 2*c* extend through the other beam 4*b* just enough to form an opening 3*a*, 3*b* in the other beam 4*b*. These openings 3*a*, 3*b* create the forklift fork insertion points. Thus, the openings 3*a*, 3*b* are spaced so as to accommodate the size and spacing of forklift forks. All four beams are made of steel, aluminum, composite material or any other material suitable to withstand the force applied by the payload. In another embodiment, the adapter comprises one solid piece of metal molded from a cast rather than separate beams welded together.

During operation, the adapter 1 is placed on top of the payload. In one illustrative embodiment, the payload is loose lumber or drywall. However, many other payloads may be transported with the adapter including other loose materials, crates, and pallets. The adapter 1 may be placed on top of the payload either by the forklift or some other suitable mechanical or physical means. If the adapter 1 is lifted on top of the payload by the forklift, the forklift will approach the adapter with forks aligned with the openings 3*a*, 3*b* and insert the forks into the openings 3*a*, 3*b*. The operator may then lift the adapter by lifting the forks, and place the adapter 1 on top of the payload. The adapter will be positioned such that the payload is located in the carriage of the adapter, which is between the other two beams 4*a*, 4*b*. Once the adapter is in the correct position on top of the payload, the payload is secured to the adapter through any suitable payload securing means 15, 21. In one embodiment, the securing means comprises hooks on the adapter and material straps with corresponding hooked ends. In other embodiments, a rope or chain may be used as the securing means. In one or more embodiments the securing means may be ratcheted down to ensure that the payload is secured to the adapter. Once the adapter 1 is secured to the payload, the payload is ready for transportation. The operator raises and aligns the forks of the fork lift to match the height of the openings 3*a*, 3*b* of the adapter on top of the payload. The operator maneuvers the forklift towards the adapter-secured payload and inserts the forks into the openings 3*a*, 3*b* of the adapter and, once in position, raises the forks to lift the entire payload off of the ground. With the payload suspended, the operator may maneuver the forklift to the specified drop location. Once the operator arrives at the specified drop location, the payload may be lowered by lowering the forks until the bottom of the payload rests on the surface of the specified drop location. With the payload in the desired position, the securing means is removed and the forklift can reverse away from the payload, leaving the adapter in place.

Because the forks are located above the payload, the adapter 1 creates a substantial vertical clearance between the forks and the surface of the specified drop location. Furthermore, the adapter allows the forklift to lift the payload from above the payload rather than below. These features allow the forklift to reverse away from the payload once it is in position, avoiding any structural obstacles of the specified drop location. Furthermore, the adapter 1 allows for more exact placement of the payload because the adapter 1 also creates a horizontal clearance between the payload and the frame of the forklift. This clearance allows the payload to extend out farther from the frame of the forklift and, therefore, place the payload a distance farther away from the forklift than a traditional forklift without the adapter. The vertical and horizontal clearances created by the adapter are especially advantageous when loading onto a specific drop location with a railing or other raised barrier to the floor of the specified drop location. However, the adapter may be used in any number of loading conditions including when there are no barriers at all.

Figure 4:
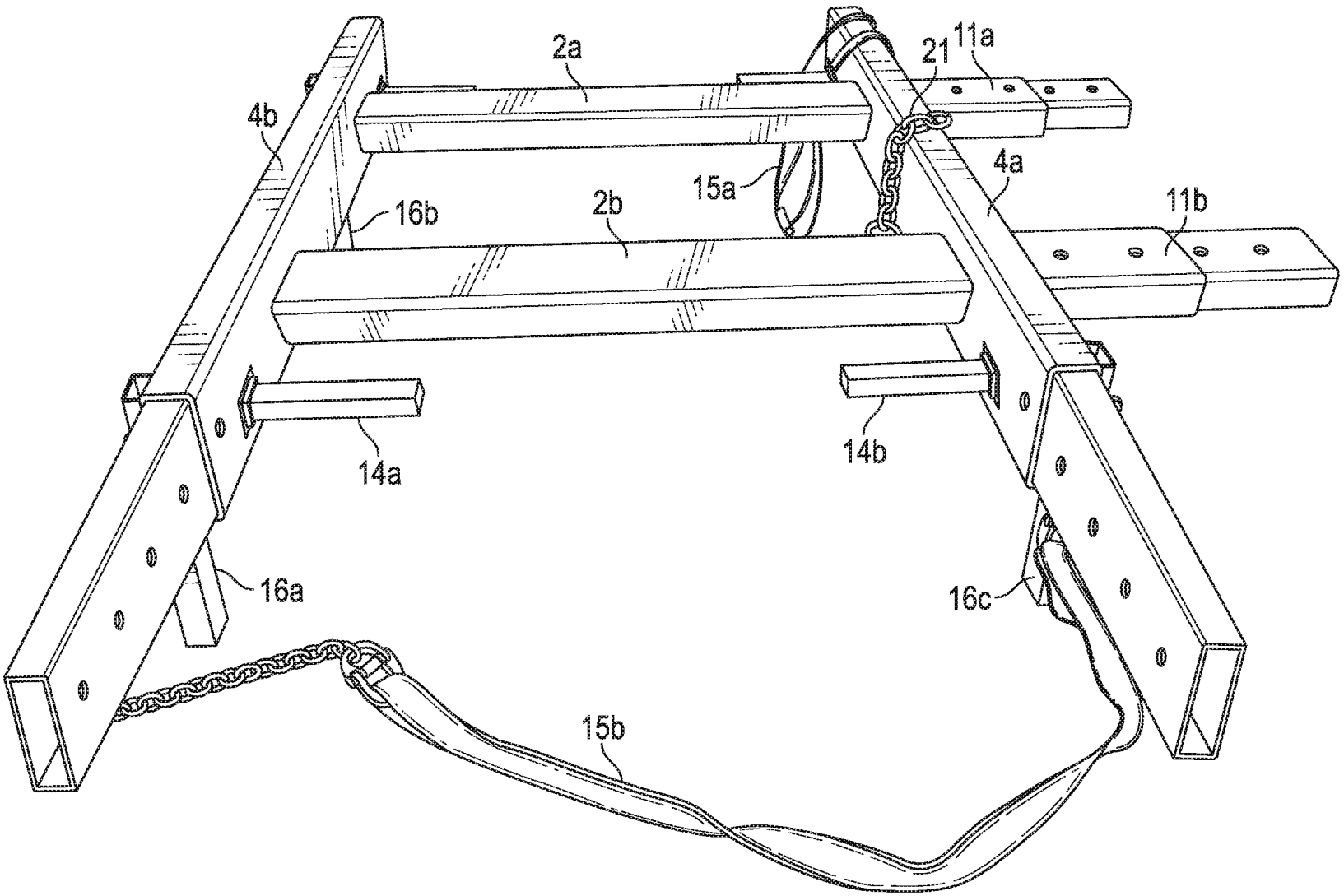
FIG. 4 is a depiction of one embodiment of the Forklift Adapter which comprises telescoping beams and payload securing means.

FIG. 4 depicts an alternate embodiment of the Forklift Adapter in which the other two beams 4*a*, 4*b* are capable of extending and retracting. This extension allows the adapter to fit various-sized forklifts with varying chassis widths. By extending the other two beams 4*a*, 4*b* the operator can create greater clearance for loading onto a specific drop location with a raised barrier. In the embodiment depicted in FIG. 4, each of the other two beams 4*a*, 4*b* further comprises an inner, telescoping beam. In this embodiment, the inner telescoping beams are secured with a plurality of holes and a pin. However, the other two beams 4*a*, 4*b* may be extended and secured by any suitable means. For example, a telescoping clamp may be used. In other embodiments, a second beam is attached underneath each other two beams via a low friction connector such as rollers. In other embodiments, a second beam is attached to each of the other two beams 4*a*, 4*b* via a hinging mechanism, which allows the second beam to be swung into place during extension and tucked alongside each other two beams 4*a*, 4*b* when not in use.

As shown in FIG. 4, a plurality of strapping materials, such as web slings 15*a*, 15*b* or chains 21 may be used to keep the payload in place. Any suitable strapping material such as wire or rope may be connected to the Forklift Adapter via multiple connection points. Such connection points may suitably comprise rigging, winches, ratchets, chain clevis, chain binders, or other binders. In one or more embodiments, various connection points are located on the Forklift Adapter to provide flexibility in placement of the strapping material.

In one or more embodiments, vertical stabilizers 16*a-d* alone or in combination with horizontal stabilizers 14*a, b* may be used to keep the load from shifting or swinging during transport. The stabilizers 14, 16 may be connected to the Forklift Adaptor in any suitable manner For example, the stabilizers may be welded or screwed to the frame of the Forklift Adapter. In other embodiments, the stabilizers are removably attached. In other embodiments, the stabilizer connection points on the Forklift Adapter allow the user to position the stabilizers in a customized formation, based on the load characteristics. The adjustability of the stabilizers 14, 16 is produced by any suitable means. In one embodiment, the stabilizers 14, 16 are attached to the adapter via a plurality of openings on the frame of the adapter and removable screws. In one or more embodiments, the stabilizers 14, 16 are attached using a clipping mechanism. The stabilizers may be rounded, square, or rectangular tubes. In one embodiment, the stabilizers are made of aluminum; however, the stabilizers 14, 16 may be made of any suitable material. The stabilizers may be a various sizes depending on the size of the forklift and the size of the load. For example, 1×6 feet or 3×6 feet. In one or more embodiments, the length of the stabilizers may be adjusted.

Figure 5:
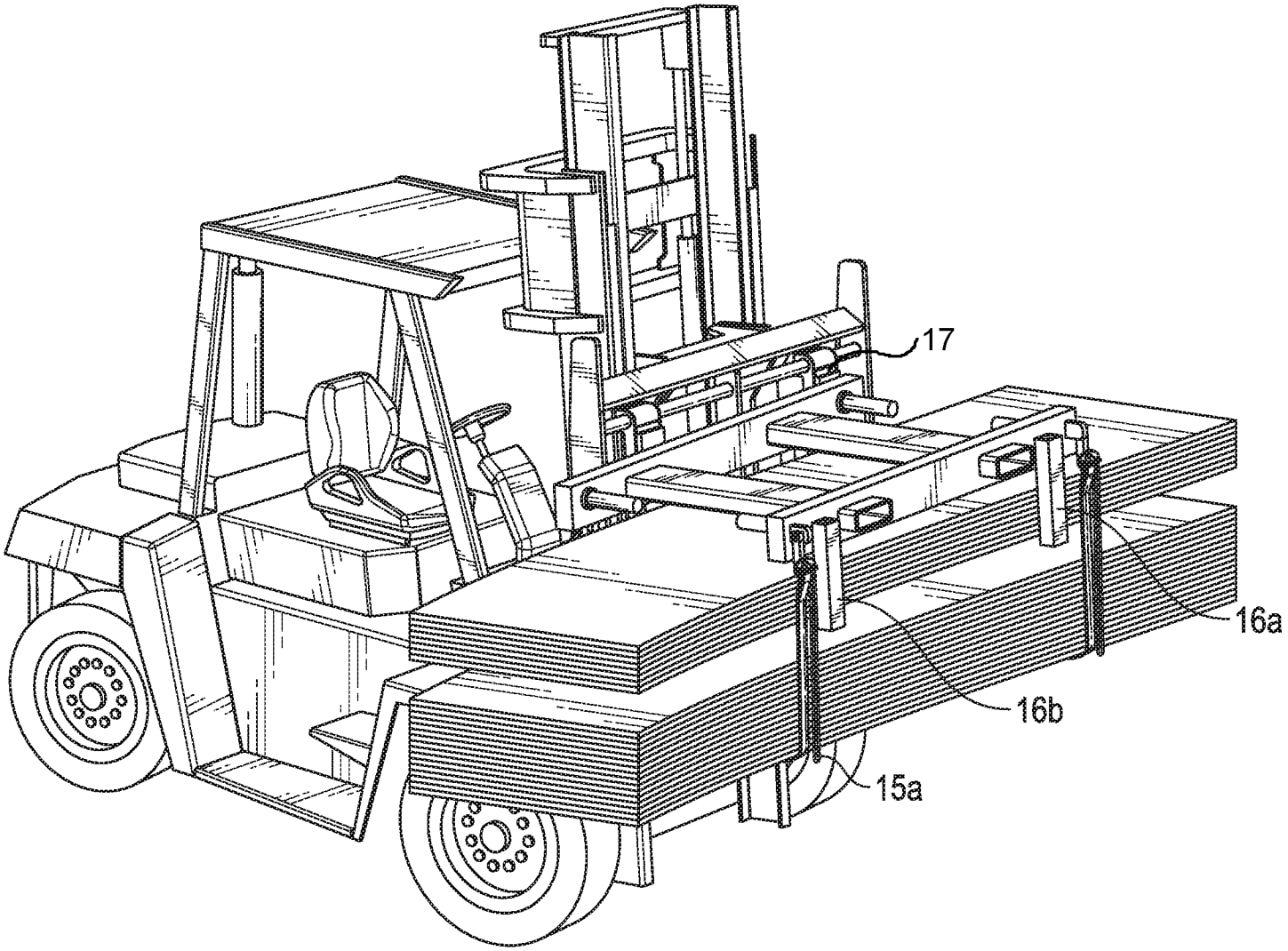
FIG. 5 is a depiction of one embodiment of the Forklift Adapter attached to a standard forklift.

Turning to FIG. 5, an embodiment of the Forklift Adapter is shown in which the adapter is coupled to a forklift. In this embodiment, the forks of the forklift are inserted into the forklift fork insertion points and the load is lifted for transport of the load. In other embodiments, the Forklift Adapter may be removabley attached to the forklift so that it is locked into place via a locking means 17. In one embodiment, the locking means 17 comprises a clamp. In other embodiments the locking means 17 comprises a release ball lock pin as known in the art.

In one or more embodiments, the Forklift Adapter is permanently attached to the forklift. In this embodiment, the Forklift Adapter is attached to the forklift by a permanent attachment means. The forks of the forklift are inserted into the Forklift Adapter and the adapter is secured to the forklift by a suitable permanent attachment means. Such suitable permanent attachment means may comprise bolts or clamps. However, any suitable attachment means may be used.

In other embodiments, the forks of the forklift are not inserted into the insertion points of the Forklift Adapter. In one suitable embodiment, the permanent attachment means is one or more hinges connected on one end to one or more of the other two beams 4*a, 4b* and connected at the other end to the chassis of the forklift. In this embodiment, the Forklift Adapter may be flipped up and out of the way of the standard carriage forks when not in use. This embodiment enables the operator to use either the adapter or the forks of the forklift without the adapter.

Figure 2:
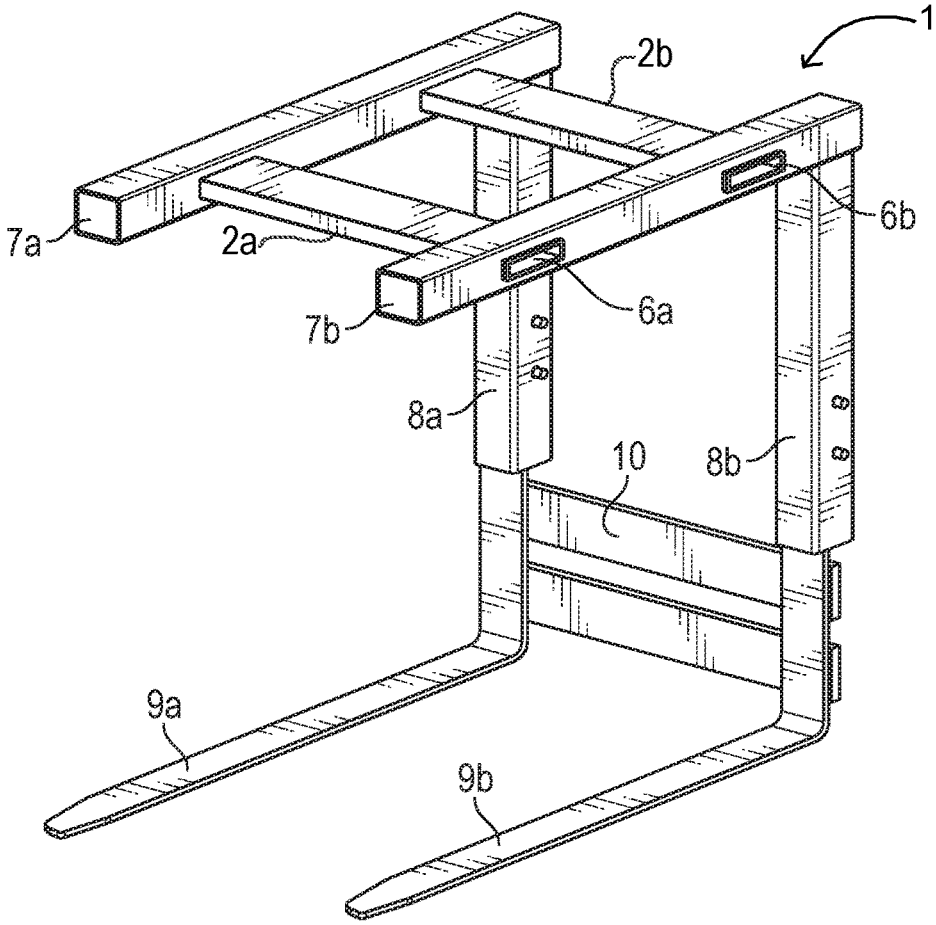
FIG. 2 is a depiction of one embodiment of the Forklift Adapter which comprises six metal support bars, a connector bar, and fork insertion points.

FIG. 2 depicts another embodiment of the Forklift Adapter. In this embodiment, rather than being directly connected to the payload carriage formed by the intersection of the two other beams 4*a, 4b* and the first set of beams 2*b, 2c*, the payload rests on the bottom supports, 9*a, 9b*. In one embodiment, the payload 13 is a pallet of goods. However, a plurality of payloads 13 may be transported with a single adapter including boxes, crates, and loose materials. The bottom supports 9*a, 9b*, are shaped substantially similar to the forks of a forklift and are made of any metal suitable for supporting the weight of various payloads. In one embodiment, the bottom supports 9*a, 9b* are approximately 36 to 42 inches in length. However, in other embodiments the bottom supports may be varying lengths based on the size of the forklift and expected payloads. The bottom supports 9*a, 9b* are parallel to each other and in one embodiment are approximately 18 to 27 inches apart. However, in other embodiments, the spacing may vary based on the size of the forklift and expected payload.

Two support beams 7*a, 7b* run parallel to the bottom supports 9*a, 9b*. In one embodiment, the support beams 7*a, 7b* are made of metal bars, such as aluminum or steel, which are approximately 42 inches in length and 8 inches in width. In other embodiments, the dimensions of the support beams 7*a, 7b* vary based on the specifications of the forklift and expected payloads.

In one embodiment, the support beams 7*b* comprises two openings 6*a, 6b* that run through the width of the support beam 7*b*. These openings 6*a, 6b* form the forklift fork insertion points. In one embodiment, the openings 6*a, 6b* are approximately 8 inches by 3 inches and approximately 12 to 24 inches apart; however, in other embodiments the openings' dimensions may vary based on the dimensions of the forklift and expected payloads. In one embodiment, the openings 6*a, 6b* are substantially centrally located on the support beam 7*b*. The other support beam 7*a* comprises openings (not pictured) that correspond in location and size to the openings 6*a, 6b* of the previously described support beam 7*b*.

Figure 3:
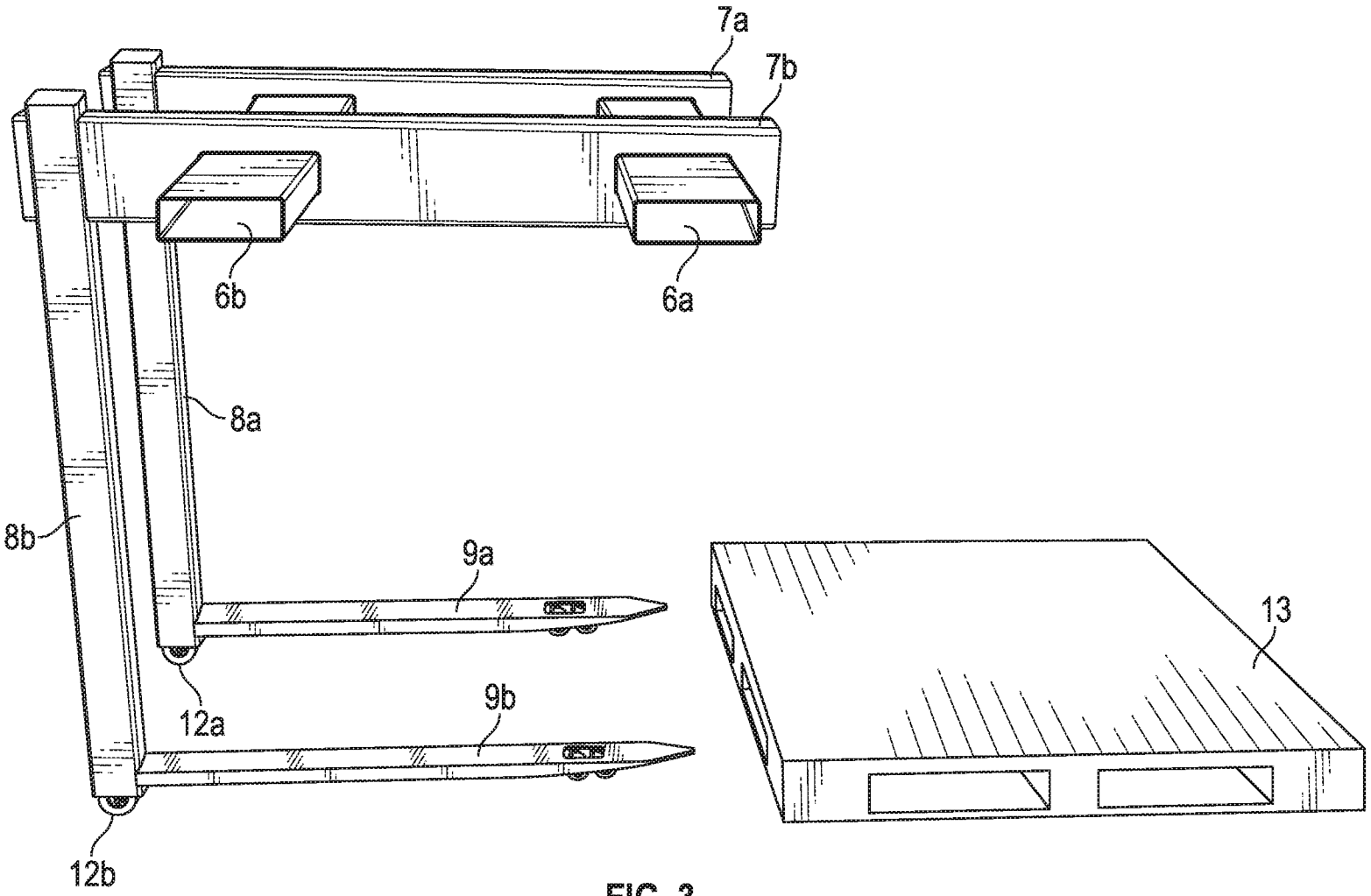
FIG. 3 is side view of the embodiment depicted in FIG. 2, shown in relation to a pallet.
Figure 6:
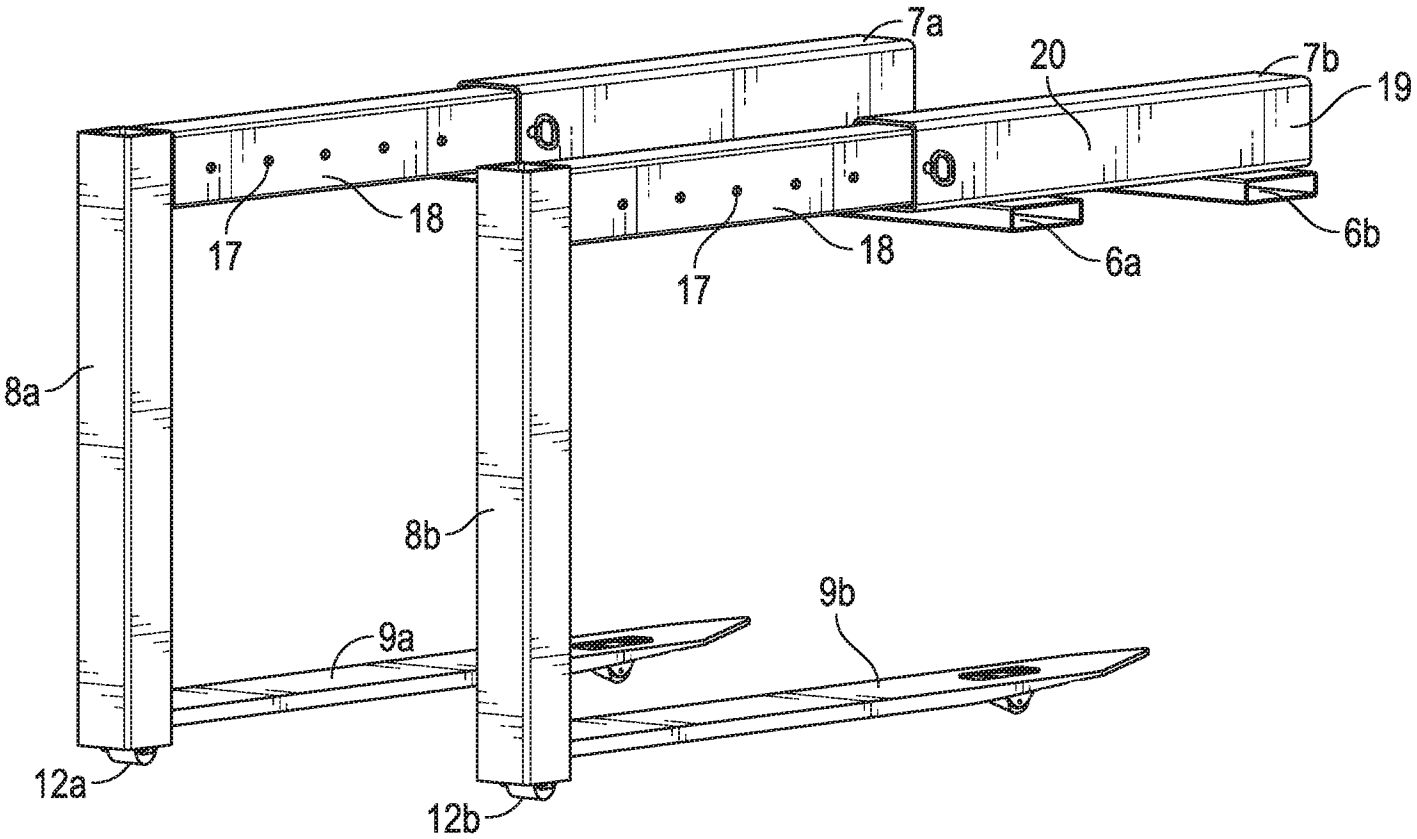
FIG. 6 is a depiction of one embodiment of the Forklift Adapter which comprises telescoping beams and caster wheels.

In one or more embodiments, the two supports beams 7*a, 7b* and/or the two first set of beams 2*a, 2b* may be extendable. FIG. 6 depicts an embodiment in which the two support beams 7*a, 7b* are extended. In the depicted embodiment, the support beams 7*a, 7b* are extended via a telescoping mechanism in which the inner beams 18 fit inside of the support beams 7*a, 7b*. The inner beams comprise pin holes 17 and a pin to lock the support beams 7*a, 7b* in place. However, in other embodiments, the support beams may be extended and retracted using any suitable means-for example, removable screws, a clipping means, or corresponding slotted grooves. FIGS. 3 and 6 also depict the first set of beams 2*a, 2b* extending beyond the support beams 7*a, 7b*. This extension may be permanent or adjustable. As depicted, the extension is permanent based on the size of the first set of beams 2*a, 2b*; however, the first set of beams 2*a, 2b* may be adjustable in the same manner as the supports beams 7*a, 7b*.

Figure 7:
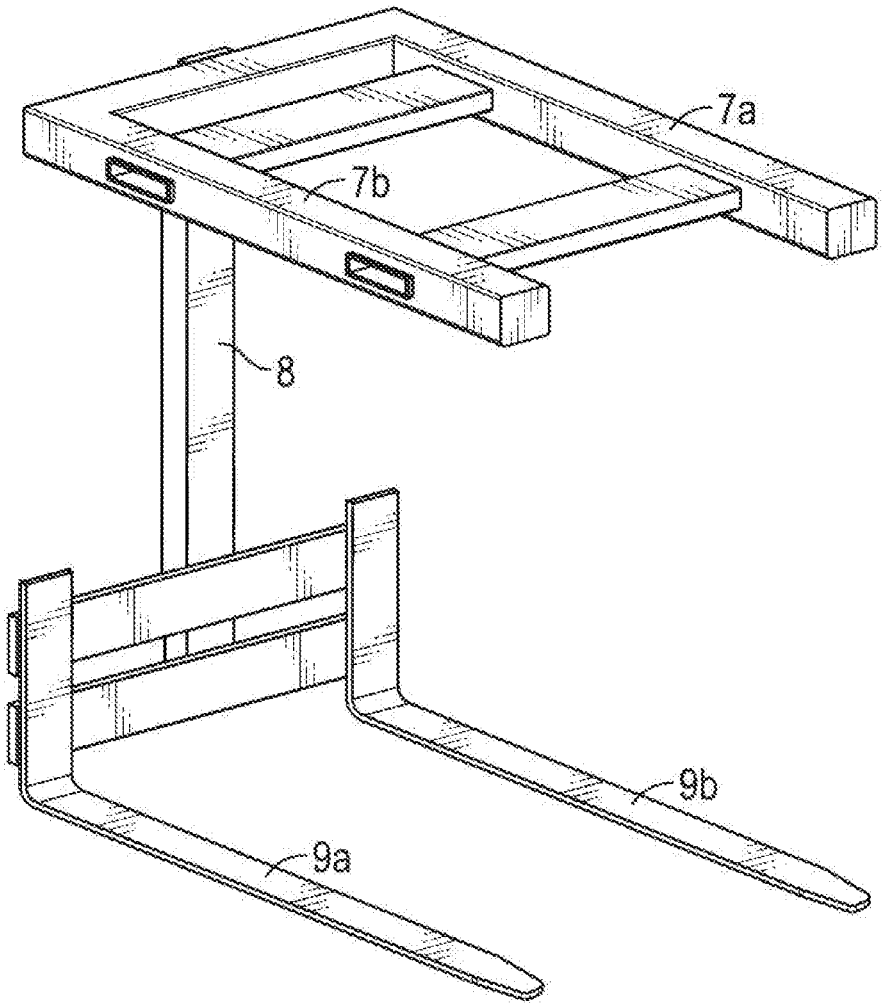
FIG. 7 is a depiction of one embodiment of the Forklift Adapter which comprises a single vertical support.

The support beams 7*a, 7b* and bottom supports 9*a, 9b* are attached to a pair of vertical supports 8*a*, 8*b*. The combination of the vertical supports 8*a*, 8*b* and the bottom supports 9*a, 9b* create the payload securing means. In one embodiment the vertical supports 8*a*, 8*b*, are between 40 and 50 inches in length and approximately 4 inches wide. However, in other embodiments the dimensions of the vertical supports 8*a*, 8*b* may vary based on the specifications of the forklift, forks, and payload. The vertical supports 8*a*, 8*b* may be rounded tubes or they may be beams. In other embodiments, such as depicted in FIG. 7, there may be only one vertical support 8.

Each support beam 7*a, 7b* and bottom support 9*a, 9b* is attached at one end to a vertical support 8*a*, 8*b* such that the support beams 7*a, 7b* and bottoms supports 9*a, 9b* are parallel to each other and perpendicular to the vertical supports 8*a*, 8*b*. In one embodiment, the support beams 7*a, 7b*, bottom supports 9*a, 9b*, and vertical supports 8*a*, 8*b* are welded at each intersection point. However, the support beams 7*a, 7b*, bottom supports 9*a, 9b*, and vertical supports 8*a*, 8*b* may be affixed to one another through any suitable means. Additionally, the bottom supports 9*a, 9b* are connected by a connector means 10. In one embodiment, the connector means 10 is another metal bar. However, the connector means 10 may be any suitable structural component, including a plate.

The supports 9*a*, 9*b* may be attached to the connector means 10 in a removable or permanent fashion. In one embodiment, the bottom supports 9*a*, 9*b* are adjustable. In one embodiment, the connector means 10 comprises two carriage bars and a quick connect system such as a lever, a release ball lock pin, or sliding grooves, as known in the art. FIG. 7 depicts the two carriage bars embodiments. In this embodiment, the bottom supports 9*a*, 9*b* may be slid horizontally across the carriage bars of the connector means 10 so that the bottom supports 9*a*, 9*b* may be adjusted based on the width of the payload 13.

In one or more embodiments, the adapter is capable of rotating from a front facing position relative to the forklift to a side position, perpendicular to the forklift, around a longitudinal axis. The rotation may be achieved using a rotatable connector means 10, such as lock and pins, hinges, ball and socket joints, or any other suitable means as known in the art in order to attach the bottom supports 9*a*, 9*b* to the vertical support 8. The rotation may be caused by the operator physically moving the adapter or by hydraulic or electric drives, as known in the art. This rotation also allows the adapter to be used with a side shift or narrow aisle forklift.

In one embodiment, the connector means 10 comprises the chassis of the forklift itself and a permanent attachment means. The permanent attachment means of the connector means 10 allows the user to operate the forklift with the adapter attached at all times, rather than continuously removing and inserting the forklift forks into the openings 6*a*, 6*b*. In this embodiment, the adapter may use a hydraulic side shift which allows the bottom supports 9*a*, 9*b* to be inserted, withdrawn, and reversed away from the payload 13 without the operator physically manipulating the adapter.

In order to transport a payload, the operator first aligns the forklift forks with the openings 6*a*, 6*b* of the support beam 7*b* such that the forks of the forklift can slide into the openings 6*a*, 6*b*. The forks of the forklift pass through the openings 6*a*, 6*b* of the support beam 7*b* and continue through the corresponding openings of the other support beam 7*a*. In this way, the forks of the forklift extend across and are perpendicular to the support beams 7*a*, 7*b*. The forklift may also pass through the openings of the other support beam 7*a* first for ease of forklift operator maneuvering or to avoid obstacles such as other payloads or walls. The operator may choose to secure the payload 13 with any number of strapping means or safety chains.

Once the forks are inserted into the openings of both of the support beams 7*a*, 7*b* the operator may lift the forks and raise the adapter off of the ground creating vertical clearance. The operator then maneuvers the forklift and adapter to a payload and lowers the forks so that the bottom supports 9*a*, 9*b* align with the insertion point on the payload. One adapter is capable of transporting a plurality of payloads. In one embodiment, the payload is a pallet and the insertion point is the point at which a conventional forklift would insert the forks into the pallet. Other embodiments include other payloads such as crates, boxes, and lose materials with varying insertion points.

Once the bottom supports 9*a*, 9*b* are aligned with the insertion point of the payload, the operator may drive the bottom supports 9*a*, 9*b* into the payload insertion points and once again lift the forks to raise the payload and create a vertical clearance. The payload is thus supported from above by the forklift with the forks inserted into the support beams 7*a*, 7*b*. The operator may then maneuver the payload to the specified drop location. Once the payload is in the desired position over the specified drop location, the operator lowers the forks, lowering the payload to the surface of the specified drop location.

Because of the vertical clearance between the support beams 7*a*, 7*b* and the surface of the drop off point provided by the length of the vertical supports 8*a*, 8*b*, the forklift may be reversed away from the payload despite any structural obstacles on the drop off point (such as railing). In one embodiment, the adapter comprises wheels 12*a*, 12*b* on the underside of the bottom supports 9*a*, 9*b* to facilitate removing the adapter. In other embodiments, the underside of the bottom supports 9*a*, 9*b* comprise any low friction mechanism or coating that allows the adapter to be removed from the payload after the payload is positioned on the surface of the drop off point, such as jack casters, footpads, or low-friction coating.

In the embodiment depicted in FIG. 6, the extension of the support beams 7*a*, 7*b* facilitate removing the adapter from the load and away from the payload 13. When the forklift forks are first inserted into the support beams 7*a*, 7*b* to begin transporting the payload 13, the support beams 7*a*, 7*b* are retracted. Once the payload 13 is lowered to the desired location, the supports beams 7*a*, 7*b* are extended, removing the bottom supports 9*a*, 9*b* out from under the payload 13. In this embodiment, the forklift insertion points are located on the first two beans 2*a*, 2*b* and below the support beams 7*a*, 7*b*. The support beams 7*a*, 7*b* may be extended physically by the user. However, in other embodiments, the support beams 7*a*, 7*b* are extended mechanically, for example, by hydraulic or electric drive. Once the support beams 7*a*, 7*b* are extended and the bottom supports 9*a*, 9*b* have cleared the payload 13, the operator may lift the adapter with the forklift and reverse away.

For the purpose of understanding the Fork Lift Adapter, references are made in the text to exemplary embodiments of a Forklift Adapter, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the Forklift Adapter may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change to the basic function to which it is related.

The invention claimed is:

1. A forklift adapter comprising:

a. a payload carriage consisting of two parallel beams, said beams each having two ends and one forklift fork insertion opening, said forklift insertion opening being sized so as to accommodate coupling of the forks of a forklift with said forklift adapter and being positioned so that when said forks of a forklift are coupled with said adapter, said forks of a forklift are perpendicular to said two parallel beams;

b. at least two stabilizers, said stabilizers being positioned so as to restrict the movement of said payload when said forks of a forklift are coupled with said forklift insertion openings; and c. a payload securing means.

2. The forklift adapter of claim 1 wherein said securing means comprises at least one strap selected from the group consisting of websling, chain, wire, and rope.

3. The forklift adapter of claim 1 wherein said at least one beam further comprises an extension and retraction means.

4. A forklift adapter comprising a payload securing means and a first set of parallel beams and a second set of parallel beams such that said first set of parallel beams is perpendicular to set second set and wherein said second set of parallel beams comprises fork lift insertion points and set first set of parallel beams comprises at least one stabilizer on each of said first set of parallel beams and wherein said first set of parallel beams and said second set of parallel beams each comprises an extension and retraction means.

5. A method for transporting and loading payloads over an obstruction comprising:

a. coupling the forks of a forklift with a forklift adapter wherein said forklift adapter comprises a payload carriage and wherein said payload carriage comprises at least one vertical support connected to at least one beam at one end and to two bottom supports at the other end, wherein said two bottom supports are shaped substantially like the forks of a forklift and are parallel to said at least one beam, said at least one beam comprising at least two forklift fork insertion points so that said coupling is performed by driving said forks into said forklift fork insertion points;

b. transporting said coupled forklift adapter to a payload;

c. securing said payload to said payload carriage and lifting said forks of said forklift;

d. driving said forklift to a specified drop location;

e. placing said payload in said specified drop location so that said two bottom supports are in contact with the surface of said drop location;

f. uncoupling said forks from said forklift adapter by reversing said forklift away from said payload while said two bottom supports remain in contact with said surface of said drop location; and g. moving said forklift adapter away from said payload using a transport aid, said transport aid being selected from the group consisting of wheels, castor wheels, and low-friction coating.

6. The method of claim 5 wherein said at least one beam further comprises an extension and retraction means.

7. The method of claim 6 further comprising the step of extending said at least one beam before said reversing step.

8. The method of claim 7 wherein said extending step is performed by a means selected from the group consisting of physical manipulation by the forklift operator, hydraulic drive, or electric drive.

* * * * *